US007324101B2

(12) United States Patent
Miyazawa

(10) Patent No.: US 7,324,101 B2
(45) Date of Patent: Jan. 29, 2008

(54) ELECTRONIC CIRCUIT, METHOD OF DRIVING ELECTRONIC CIRCUIT, ELECTRO-OPTICAL DEVICE, METHOD OF DRIVING ELECTRO-OPTICAL DEVICE, AND ELECTRONIC APPARATUS

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 415 days.

(21) Appl. No.: 10/645,512

(22) Filed: Aug. 22, 2003

(65) Prior Publication Data

US 2004/0095338 A1 May 20, 2004

(30) Foreign Application Priority Data

Aug. 30, 2002 (JP) ..... 2002-255255
Aug. 12, 2003 (JP) ..... 2003-207373

(51) Int. Cl.
*G09G 5/00* (2006.01)

(52) U.S. Cl. ..... 345/211; 345/204; 345/212; 345/214

(58) Field of Classification Search ..... 345/87–100, 345/204–215
See application file for complete search history.

(56) References Cited

U.S. PATENT DOCUMENTS 5,903,246 A 5/1999 Dingwall
5,952,789 A 9/1999 Stewart et al.
6,035,237 A * 3/2000 Schulman et al. ..... 607/63
6,091,203 A 7/2000 Kawashima et al.
6,229,506 B1 5/2001 Dawson et al.
6,229,508 B1 5/2001 Kane
6,246,180 B1 6/2001 Nishigaki
6,501,466 B1 * 12/2002 Yamagishi et al. ..... 345/204
6,750,833 B2 6/2004 Kasai
6,859,193 B1 2/2005 Yumoto
7,193,591 B2 3/2007 Yumoto
2002/0167504 A1 * 11/2002 Matsumoto ..... 345/204
2003/0067424 A1 * 4/2003 Akimoto et al. ..... 345/55
2004/0207615 A1 10/2004 Yumoto
2005/0190177 A1 9/2005 Yumoto

FOREIGN PATENT DOCUMENTS

JP 11-272233 10/1999
JP A 2002-140035 5/2002
JP A 2002-514320 5/2002
JP A-2002-169510 6/2002
JP A 2002-517806 6/2002
JP 2002-221936 8/2002
JP A-2003-529805 10/2003

(Continued)

*Primary Examiner*—Vijay Shankar
(74) *Attorney, Agent, or Firm*—Oliff & Berridge, PLC

(57) ABSTRACT

The present invention provides an electronic circuit, a method of driving the electronic circuit, an electro-optical device, a method of driving the electro-optical device, and an electronic apparatus capable of improving yield or aperture ratio by reducing the number of transistors to be used. A pixel circuit can include a driving transistor a transistor, a switching transistor, and a holding capacitor. Furthermore, a driving-voltage supplying transistor is connected between a first power source line, which supplies a driving voltage to drive the driving transistor, and a voltage supply line extending in a row in the direction of the pixel circuits provided at the right end side of an active matrix part.

15 Claims, 9 Drawing Sheets

FOREIGN PATENT DOCUMENTS

| | | |
|---|---|---|
| KR | 2000-71301 | 11/2000 |
| KR | 2001-0085788 | 9/2001 |
| WO | WO 98/33165 | 7/1998 |
| WO | WO 98/48403 A1 | 10/1998 |
| WO | WO 99/65011 A1 | 12/1999 |
| WO | WO 01/75852 A1 | 10/2001 |
| WO | WO 01/91095 A1 | 11/2001 |

* cited by examiner

ELECTRONIC CIRCUIT, METHOD OF DRIVING ELECTRONIC CIRCUIT, ELECTRO-OPTICAL DEVICE, METHOD OF DRIVING ELECTRO-OPTICAL DEVICE, AND ELECTRONIC APPARATUS

BACKGROUND OF THE INVENTION

1. Field of Invention

The present invention relates to an electronic circuit, a method of driving the electronic circuit, an electro-optical device, a method of driving the electro-optical device, and an electronic apparatus.

2. Description of Related Art

In recent years, a screen with high definition or an enlarged screen has been required for an electro-optical device having a plurality of electro-optical elements, which is widely used as a display device. In response to such requirements, the importance of an active matrix driven electro-optical device, which includes pixel circuits for driving the plurality of electro-optical elements, relative to a passive driven electro-optical device has increased. However, in order to accomplish realization of a screen with the higher definition or an enlarged screen, it is necessary to accurately control each of the electro-optical elements. For this purpose, the deviation of the characteristics of active elements constituting the pixel circuits must be compensated.

In order to compensate for the deviation of the characteristics of active elements, the use of a display device (for example, see Japanese Unexamined Patent Application Publication No. 1999-272233), which has pixel circuits including diode-connected transistors, has been suggested.

SUMMARY OF THE INVENTION

However, a pixel circuit that compensates for the deviation of the characteristics of an active element generally includes four or more transistors, and, as a result, the deterioration in yield or aperture ratio occurs.

An object of the present invention can be to provide an electronic circuit, a method of driving the electronic circuit, an electro-optical device, a method of driving the electro-optical device, and an electronic apparatus capable of reducing the number of transistors constituting a pixel circuit or a unit circuit.

A first electronic circuit according to the present invention can be an electronic circuit having a plurality of unit circuits. The electronic circuit can include first power source lines. Each of the plurality of unit circuits can include a first transistor connected in series to an electronic element and connected to the first power source line, a second transistor for controlling an electrical connection between a drain of the first transistor and a gate of the first transistor, and a third transistor for controlling an electrical connection between the first transistor and a current source outputting a data current for setting an electrical connection state of the first transistor. At least for part of the time period in which the third transistor is in an on state, the first power source line is electrically disconnected from a driving potential, and at least for part of the time period in which the third transistor is in an off state, a current corresponding to the electrical connection state of the first transistor set by the data current flows between the first power source line and the electronic element.

In the above electronic circuit, controlling the electrical connection between a drain of the first transistor and a gate of the first transistor can include a circumstance in which the drain of the first transistor is electrically connected to the gate of the first transistor through an element, such as the third transistor, or a wiring line, as well as a circumstance in which the drain of the first transistor is electrically connected directly to the gate of the first transistor.

A second electronic circuit according to the present invention is an electronic circuit having a plurality of unit circuits. The electronic circuit can include first power source lines; and control circuits, each setting the potential of the first power source line or controlling the supply and the disconnection of a driving voltage to the first power source line. Each of the plurality of unit circuits can include a first transistor connected in series to an electronic element and connected to the first power source line, a second transistor for controlling an electrical connection between a drain of the first transistor and a gate of the first transistor, and a third transistor for controlling an electrical connection between the first transistor and a current source outputting a data current for setting an electrical connection state of the first transistor. At least for part of the time period in which the third transistor is in an off state, a current corresponding to the electrical connection state of the first transistor set by the data current flows between the first power source line and the electronic element.

In the above electronic circuit, the drain can be determined by the conductive type of the first transistor and the relative relationship between the potentials of two terminals sandwiching a channel of the first transistor when a data current flows through the first transistor. For example, when the first transistor is a p type, one terminal having the lower potential of the two terminals of the first transistor is used as a drain, and when the first transistor is an n type, one terminal having the higher potential of the two terminals of the first transistor is used as a drain.

In the above electronic circuit, the electronic element can include, for example, an electro-optical element, a resistor element, a diode and the like.

A third electronic circuit according to the present invention can be an electrical circuit having a plurality of unit circuits. Each of the plurality of unit circuits can include a first transistor having a first terminal, a second terminal, and a first control terminal, a second transistor having a third terminal and a fourth terminal, the third terminal being connected to the first control terminal, the second transistor controlling an electrical connection between the second terminal and the third terminal, a third transistor having a fifth terminal and a sixth terminal, the fifth terminal being connected to the first terminal, and a capacitive element having a seventh terminal and an eighth terminal. The seventh terminal being connected to the first control terminal and the third terminal. The first terminal is connected to a first power source line together with the first terminals of other unit circuits of the plurality of unit circuits. The electronic circuit can include a plurality of control circuits, each setting a potential of the first power source line to a plurality of potentials or controlling the supply and the disconnection of a driving voltage to the first power source line.

The first transistor, the first terminal, the second terminal, and the first control terminal as described above correspond to a driving transistor Q1, a source of the driving transistor Q1, a drain of the driving transistor Q1, and a gate of the driving transistor Q1, respectively, in a pixel circuit as shown in FIG. 3, which shows an embodiment to be described in greater detail below.

Further, the second transistor, the third terminal, the fourth terminal, and a second control terminal correspond to a transistor Q2, a source of the transistor Q2, a drain of the transistor Q2, and a gate of the transistor Q2, respectively.

Furthermore, the third transistor, the fifth terminal, the sixth terminal, and a third control terminal correspond to a switching transistor Q3, a source of the switching transistor Q3, a drain of the switching transistor Q3, and a gate of the switching transistor Q3, respectively.

Moreover, the capacitive element, the seventh terminal, and the eighth terminal correspond to a holding capacitor Co, a first electrode La of the holding capacitor Co, and a second electrode Lb of the holding capacitor Co, respectively.

According to such construction, a unit circuit having fewer transistors than does a conventional unit circuit can be constructed.

A fourth electronic circuit according to the present invention can be an electrical circuit having a plurality of unit circuits. Each of the plurality of unit circuits can include a first transistor having a first terminal, a second terminal, and a first control terminal, a second transistor having a third terminal and a fourth terminal, the third terminal being connected to the first control terminal, the second transistor controlling an electrical connection between the second terminal and the third terminal, a third transistor having a fifth terminal and a sixth terminal, the fifth terminal being connected to the first terminal, and a capacitive element having a seventh terminal and an eighth terminal, the seventh terminal being connected to the first control terminal and the third terminal. The first terminal is connected to a first power source line together with the first terminals of other unit circuits of the plurality of unit circuits, and the eighth terminal is connected to a second power source line, which is held at a predetermined potential, together with the eighth terminals of other unit circuits of the plurality of unit circuits. The electronic circuit can include a plurality of control circuits, each setting the potential of the first power source line to a plurality of potentials or controlling the supply and the disconnection of a driving voltage to the first power source line.

According to such construction, it is possible to stably maintain a voltage in the capacitive element, as well as to construct a unit circuit having fewer transistors than does a conventional unit circuit.

In the above electronic circuit, transistors included in each of the unit circuits comprise only the first transistor, the second transistor, and the third transistor. According to such construction, it is possible to construct a unit circuit having one fewer transistors than does a conventional unit circuit.

In the above electronic circuit, an electronic element is connected to the second terminal. According to such construction, it is possible to control the electronic element using a circuit having one fewer transistors than does a conventional circuit.

In the above electronic circuit, the electronic element may be a current-driven element. According to such construction, it is possible to control the current-driven element using a circuit having one fewer transistors than does a conventional circuit.

In the above electronic circuit, the control circuit may be a fourth transistor having a ninth terminal and a tenth terminal. The ninth terminal may be connected to the driving voltage, and the tenth terminal may be connected to the first power source line. According to such construction, the control circuit can be easily constructed.

A method of driving the first electronic circuit according to the present invention is a method of driving an electronic circuit having a plurality of unit circuits, the electronic circuit can include first power source lines. Each of the plurality of unit circuits can include a first transistor connected in series to an electronic element and connected to the first power source line, a second transistor for controlling an electrical connection between a drain of the first transistor and a gate of the first transistor, and a third transistor for controlling an electrical connection between the first transistor and a current source outputting a data current for setting an electrical connection state of the first transistor. The method can include a first step of switching the third transistor to an on state to supply the data current to the first transistor and thus setting the electrical connection state of the first transistor, and a second step of switching the third transistor to an off state and making a current corresponding to the electrical connection state of the first transistor flow between the first power source line and the electronic element, At least for part of the time period in which in the first step the data current is supplied to the first transistor, the first power source line is electrically disconnected from a driving voltage. At least for part of the time period in which the second step is performed, the driving voltage is applied to either the drain of the first transistor or the source of the first transistor through the first power source line.

A method of driving the second electronic circuit according to the present invention is a method of driving an electronic circuit having a plurality of unit circuits. Each of the plurality of unit circuits can include a first transistor having a first terminal, a second terminal, and a first control terminal, a second transistor having a third terminal and a fourth terminal, the third terminal being connected to the first control terminal, the fourth terminal being connected to the second terminal, a third transistor having a fifth terminal and a sixth terminal, the fifth terminal being connected to the first terminal, and a capacitive element having a seventh terminal and an eighth terminal, the seventh terminal being connected to the first control terminal and the third terminal. The first terminal is connected to a first power source line together with the first terminals of a series of unit circuits of the plurality of unit circuits. The method can include a step of electrically disconnecting the first terminals of the series of unit circuits from a driving voltage by electrically disconnecting the first power source line from the driving voltage, causing a quantity of charge corresponding to the current level of a current flowing through the first transistor to be held in the capacitive element by switching the third transistor of each of the series of unit circuits to an on state, and applying a voltage corresponding to the quantity of charge to the first control terminal to set an electrical connection state between the first terminal and the second terminal, and a step of switching the third transistor to an off state and electrically connecting the first terminal of each of the series of unit circuits to the driving voltage.

A method of driving the third electronic circuit according to the present invention can be a method of driving an electronic circuit having a plurality of unit circuits. Each of the plurality of unit circuits can include a first transistor having a first terminal, a second terminal, and a first control terminal, a second transistor having a third terminal and a fourth terminal, the third terminal being connected to the first control terminal, the fourth terminal being connected to the second terminal, a third transistor having a fifth terminal and a sixth terminal, the fifth terminal being connected to the first terminal, and a capacitive element having a seventh terminal and an eighth terminal, the seventh terminal being connected to the first control terminal and the third terminal. The first terminal can be connected to a first power source line together with the first terminals of a series of unit circuits of the plurality of unit circuits, and the eighth terminal is connected to a second power source line together with the eighth terminals of the series of unit circuits of the plurality of unit circuits. The method can include a step of electrically disconnecting the first terminals of the series of unit circuits from a driving circuits by electrically disconnecting the first power source line from the driving voltage, causing a quantity of charge corresponding to the current level of a current flowing through the first transistor to be held in the capacitive element by switching the third transistor of each of the series of unit circuits to an on state, and applying a voltage corresponding to the quantity of charge to the first control terminal to set an electrical connection state between the first terminal and the second terminal, and a step of switching the third transistor to an off state and electrically connecting the first terminal of each of the series of unit circuits to the driving voltage.

According to such a method of driving the third electronic circuit, the unit circuit may be made to comprise as few transistors as possible.

A first electro-optical device according to the present invention can be an electro-optical device having a plurality of scanning lines, a plurality of data lines, a plurality of first power source lines, and a plurality of unit circuits. Each of the plurality of unit circuits can include a first transistor connected in series to an electro-optical element and connected to the corresponding first power source line of the plurality of first power source lines, a second transistor for controlling an electrical connection between a drain of the first transistor and a gate of the first transistor, and a third transistor for controlling an electrical connection between the first transistor and the corresponding data line of the plurality of data lines, the third transistor being controlled by a scanning signal supplied through the corresponding scanning line of the plurality of scanning lines. At least for part of the time period in which the third transistor is in an on state, the corresponding first power source line is electrically disconnected from a driving voltage and a data current supplied from the corresponding data line is made to flow in the first transistor to set the electrical connection state of the first transistor. At least for part of the time period in which the third transistor is in an off state, the driving voltage is applied to either the drain of the first transistor or the source of the first transistor, a current corresponding to the electrical connection state of the first transistor set by the data current flows between the corresponding first power source line and the electro-optical element.

In the above electro-optical device, controlling the electrical connection between a drain of the first transistor and a gate of the first transistor includes a circumstance in which the drain of the first transistor is electrically connected to the gate of the first transistor through another transistor, such as the third transistor, or a wire, such as the corresponding data line and the like, as well as a circumstance in which the drain of the first transistor is electrically connected directly to the gate of the first transistor.

A second electro-optical device according to the present invention is an electro-optical device having a plurality of scanning lines, a plurality of data lines, and a plurality of unit circuits. Each of the plurality of unit circuits can include a first transistor having a first terminal, a second terminal, and a first control terminal, a second transistor having a third terminal, a fourth terminal, and a second control terminal, the third terminal being connected to the first control terminal, a third transistor having a fifth terminal, a sixth terminal, and a third control terminal, the fifth terminal being connected to the first terminal, the sixth terminal being connected to one data line of the plurality of data lines, the third control terminal being connected to one scanning line of the plurality of scanning lines, and a capacitive element having a seventh terminal and an eighth terminal, the seventh terminal being connected to the first control terminal and the third terminal. The first terminal is connected to a first power source line together with the first terminals of other unit circuits of the plurality of unit circuits. The electro-optical device comprises a plurality of control circuits, each setting the potential of the first power source line to a plurality of potentials or controlling the supply and the disconnection of a driving voltage to the first power source line.

A third electro-optical device according to the present invention can be an electro-optical device comprising a plurality of scanning lines, a plurality of data lines, and a plurality of unit circuits. Each of the plurality of unit circuits can include a first transistor having a first terminal, a second terminal, and a first control terminal, a second transistor having a third terminal, a fourth terminal, and a second control terminal, the third terminal being connected to the first control terminal, the second transistor controlling an electrical connection between the second terminal and the fourth terminal, a third transistor having a fifth terminal, a sixth terminal, and a third control terminal, the fifth terminal being connected to the first terminal, the sixth terminal being connected to one data line of the plurality of data lines, the third control terminal being connected to one scanning line of the plurality of scanning lines, and a capacitive element having a seventh terminal and an eighth terminal, the seventh terminal being connected to the first control terminal and the third terminal. The first terminal is connected to a first power source line together with the first terminals of other unit circuits of the plurality of unit circuits. The eighth terminal is connected to a second power source line, which is held at a predetermined potential, together with the eighth terminals of other unit circuits of the plurality of unit circuits. The electro-optical device can include a plurality of control circuits, each setting the potential of the first power source line to a plurality of potentials or controlling the supply and the disconnection of a driving voltage to the first power source line.

In the above electro-optical device, the unit circuit may be made to include as few transistors as possible.

In the above electro-optical device, it is preferable that transistors in each of the unit circuits should include only the first transistor, the second transistor, and the third transistor.

In the above electro-optical device, it is preferable that the control circuit be a fourth transistor having a ninth terminal and a tenth terminal, the ninth terminal being connected to the driving voltage and the tenth terminal being connected to the first power source line. According to such construction, the control circuit can be easily constructed.

In the above electro-optical device, the electro-optical element may be, for example, an EL element. A current-driven element, such as an organic EL element, is preferable.

A method of driving the first electro-optical device according to the present invention is a method of driving an electro-optical device, the electro-optical device can include a plurality of scanning lines, a plurality of data lines, a plurality of first power source lines, and a plurality of unit circuits. Each of the plurality of unit circuits can have a first transistor connected in series to an electro-optical element and connected to the corresponding first power source line of the plurality of first power source lines, a second transistor for controlling an electrical connection between a drain of the first transistor and a gate of the first transistor, and a third transistor for controlling an electrical connection between the first transistor and the corresponding data line of the plurality of data lines, the third transistor being controlled by a scanning signal supplied through the corresponding scanning line of the plurality of scanning lines. The method can include a first step of, when the third transistor is in an on state and the corresponding first power source line is electrically disconnected from a driving voltage, making a data current supplied from the corresponding data line flow through the first transistor to set the electrical connection state of the first transistor, and a second step of, in a state that the third transistor is in an off state and the driving voltage is applied to either the drain of the first transistor or the source of the first transistor through the corresponding first power source line, making a current corresponding to the electrical connection of the first transistor set by the data current flow between the corresponding first power source line and the electro-optical element.

A method of driving the second electro-optical device according to the present invention is a method of driving an electro-optical device having a plurality of unit circuits. Each of the plurality of unit circuits can include a first transistor having a first terminal, a second terminal, and a first control terminal, a second transistor having a third terminal, a fourth terminal, and a second control terminal, the third terminal being connected to the first control terminal, the fourth terminal being connected to the second terminal, a third transistor having a fifth terminal, a sixth terminal, and a third control terminal, the fifth terminal being connected to the first terminal, a capacitive element having a seventh terminal and an eighth terminal, the seventh terminal being connected to the first control terminal and the third terminal, and an electro-optical element connected to the second terminal, the sixth terminal being connected to one data line of a plurality of data lines, the third control terminal being connected to one scanning line of a plurality of scanning lines. The first terminal is connected to a first power source line together with the first terminals of other unit circuits of the plurality of unit circuits. The method can include a step of electrically disconnecting the first terminals of a series of unit circuits from a driving voltage by electrically disconnecting the first power source line from the driving voltage, causing a quantity of charge corresponding to the current level of a current flowing through the first transistor to be held in the capacitive element by switching the third transistor of each of the series of unit circuits to an on state, and applying a voltage corresponding to the quantity of charge to the first control terminal to set an electrical connection state between the first terminal and the second terminal, and a step of switching the third transistor to an off state and electrically connecting the first terminal of each of the series of unit circuits to the driving voltage through the first power source line.

A method of driving the third electro-optical device according to the present invention is a method of driving an electro-optical device having a plurality of unit circuits. Each of the plurality of unit circuits can include a first transistor having a first terminal, a second terminal, and a first control terminal, a second transistor having a third terminal, a fourth terminal, and a second control terminal, the third terminal being connected to the first control terminal, the fourth terminal being connected to the second terminal, a third transistor having a fifth terminal, a sixth terminal, and a third control terminal, the fifth terminal being connected to the first terminal, a capacitive element having a seventh terminal and an eighth terminal, the seventh terminal being connected to the first control terminal and the third terminal, and an electro-optical element connected to the second terminal, the sixth terminal being connected to one data line of a plurality of data lines, the third control terminal being connected to one scanning line of a plurality of scanning lines. The first terminal is connected to a first power source line together with the first terminals of other unit circuits of the plurality of unit circuits, and the eighth terminal is connected to a second power source line together with the eighth terminals of the other unit circuits of the plurality of unit circuits. The method can include a step of electrically disconnecting the first terminals of a series of unit circuits from a driving voltage by electrically disconnecting the first power source line from the driving voltage, causing a quantity of charge corresponding to the current level of a current flowing through the first transistor to be held in the capacitive element by switching the third transistor of each of the series of unit circuits to an on state, and applying a voltage corresponding to the quantity of charge to the first control terminal to set an electrical connection state between the first terminal and the second terminal, and a step of switching the third transistor to an off state and electrically connecting the first terminals of the series of unit circuits to the driving voltage through the first power source line.

According to the aforementioned method of driving an electro-optical device, the deviation of the characteristics of the transistors for determining the current or the voltage supplied to the electro-optical elements can be compensated for, and the number of transistors included in a pixel circuit can be reduced to as great an extent as possible.

A first electronic apparatus according to the present invention is equipped with the aforementioned electronic circuit. The aforementioned electronic circuit can be used in a display unit or an active driving unit having an active function such as a memory unit in the electronic apparatus.

A second electronic apparatus according to the present invention is equipped with the aforementioned electro-optical device. Since the aforementioned electro-optical device can control the states of the electro-optical elements with a high degree of accuracy and has a high aperture ratio, it is possible to provide an electronic apparatus having a display unit having excellent display quality. Furthermore, since the number of transistors constituting a pixel circuit is reduced to as great an extent as possible in the aforementioned electro-optical device, it is possible to reduce the manufacturing costs.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
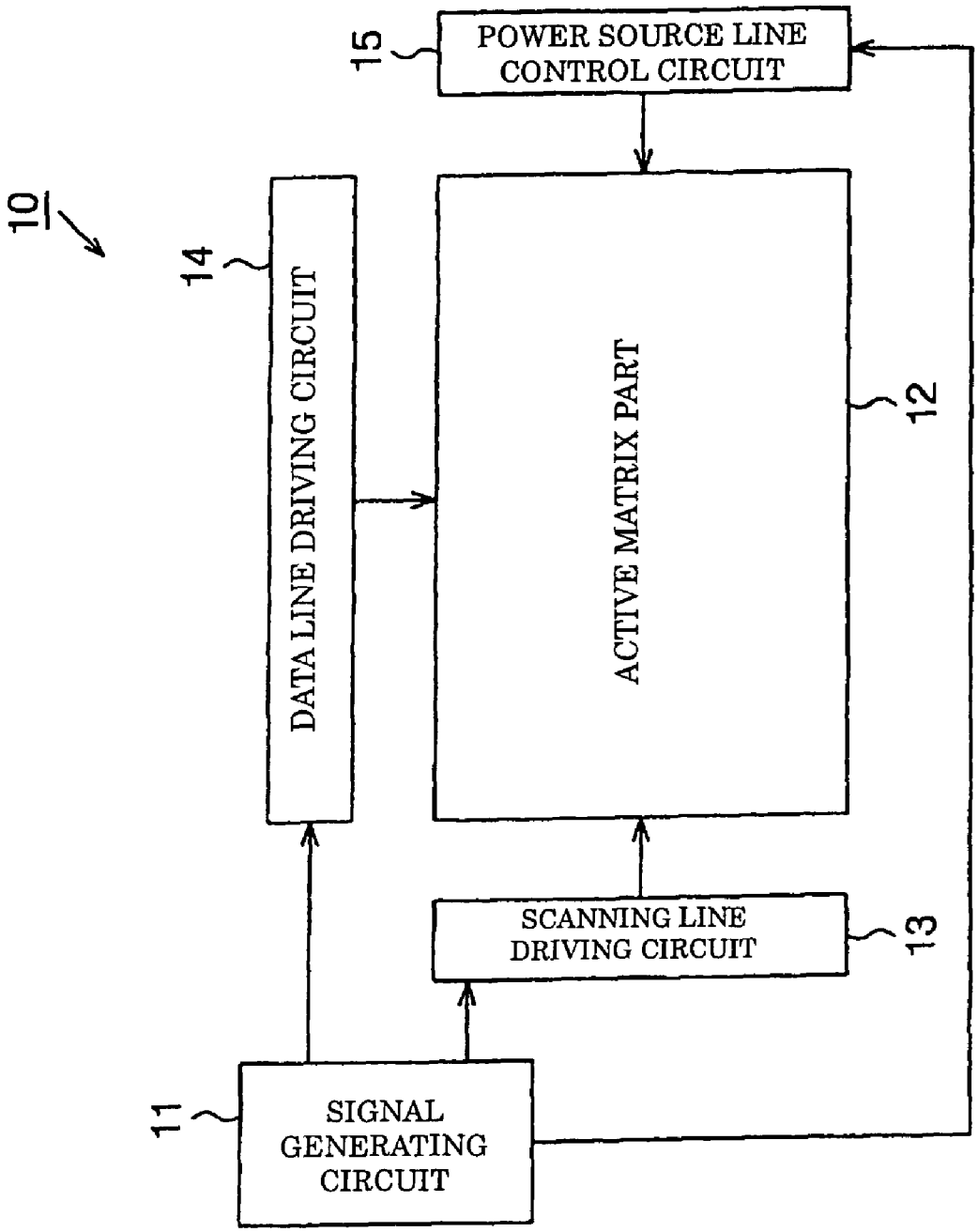
FIG. 1 is an exemplary circuitry block diagram illustrating a circuit configuration of an organic EL display device according to the first embodiment.
Figure 2:
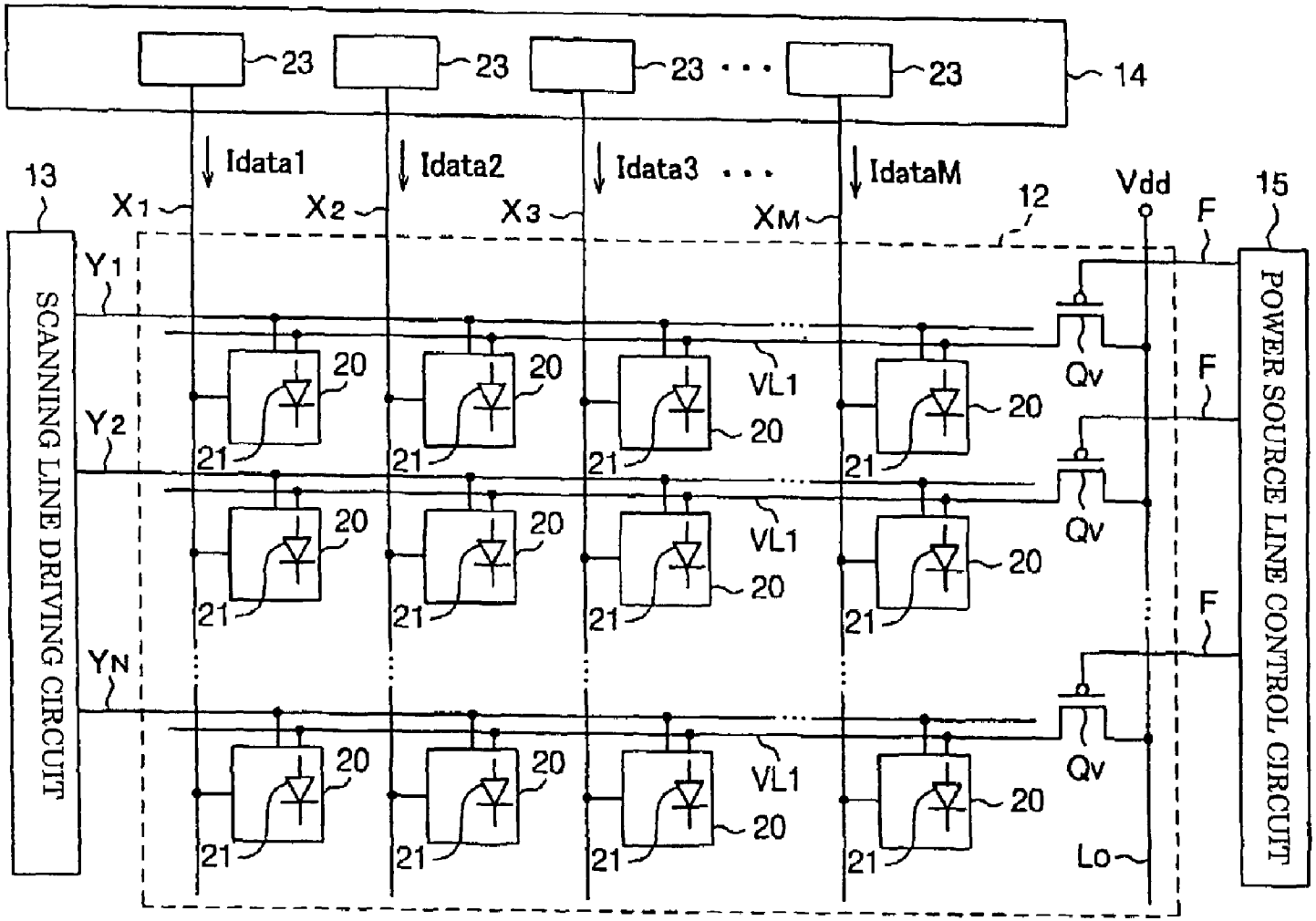
FIG. 2 is an exemplary circuitry block diagram illustrating a circuit configuration of a display panel part and a data line driving circuit according to the first embodiment.
Figure 3:
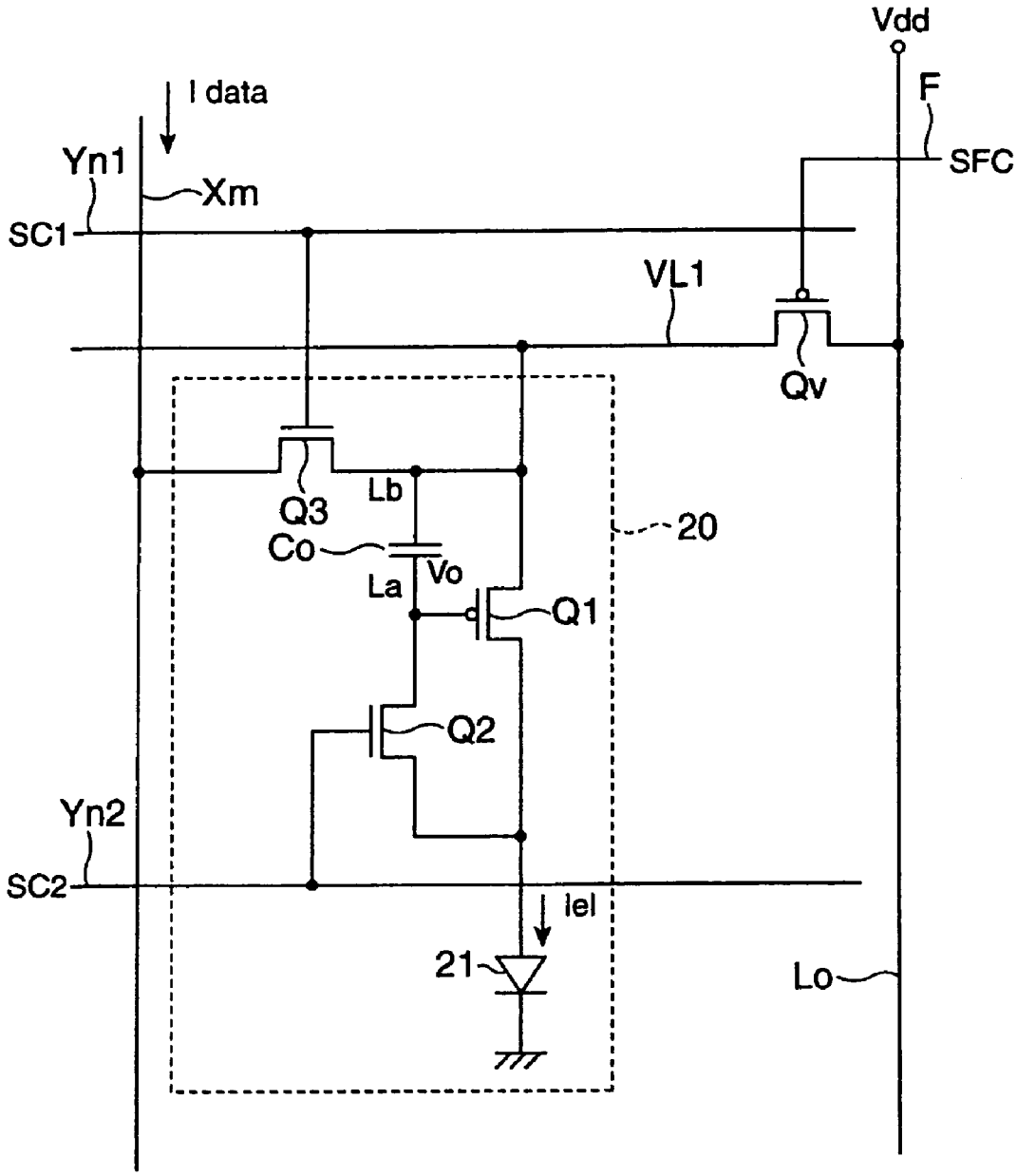
FIG. 3 is an exemplary circuit diagram of a pixel circuit according to the first embodiment.
Figure 4:
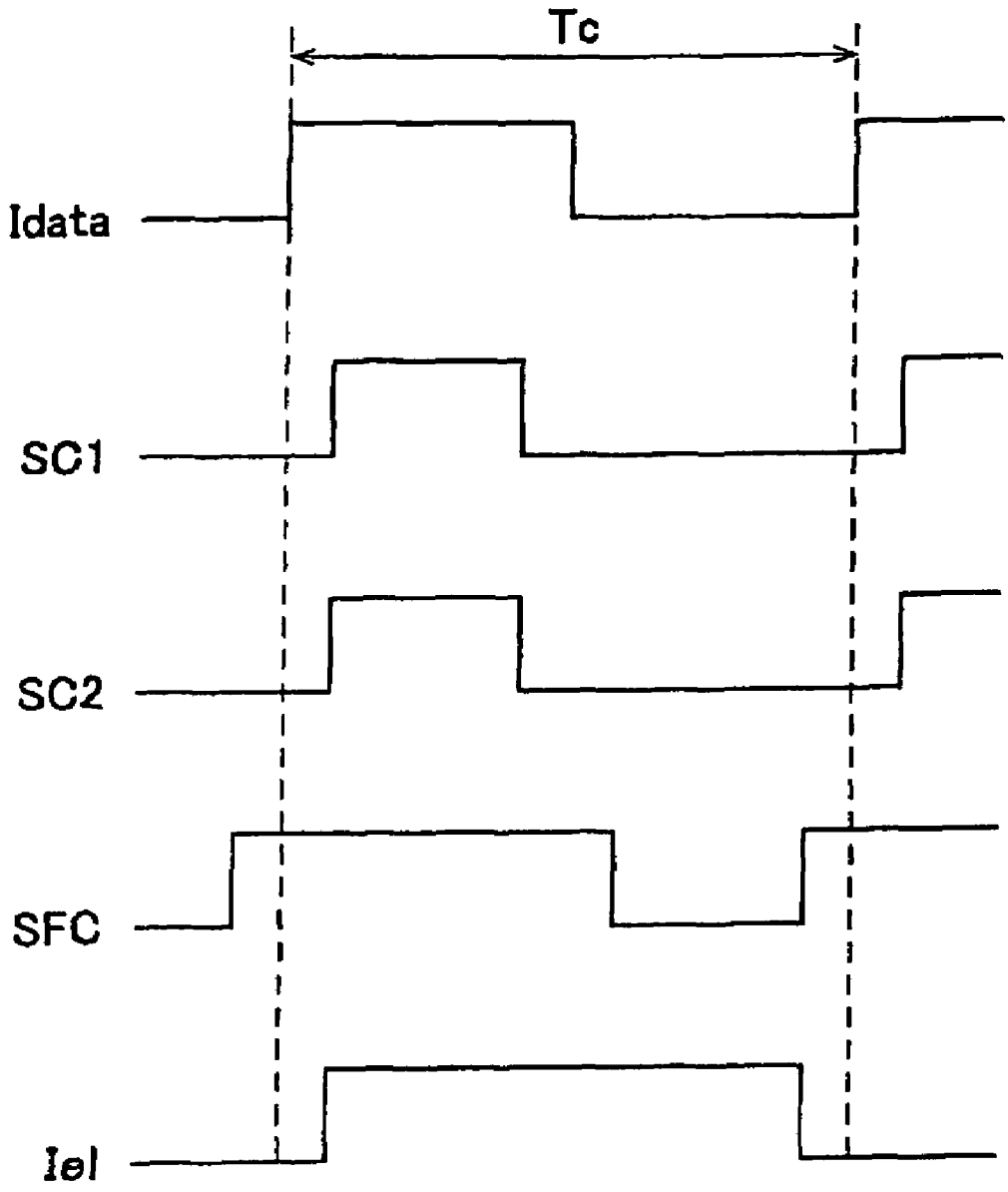
FIG. 4 is an exemplary timing chart illustrating a method of driving pixel circuits according to the first embodiment.

Now, a first embodiment of the present invention will be described with reference to FIGS. 1 to 4. FIG. 1 is an exemplary circuitry block diagram illustrating a circuit configuration of an organic EL display device as an electro-optical device. FIG. 2 is an exemplary circuitry block diagram illustrating a circuit configuration of a display panel part and a data line driving circuit. FIG. 3 is an exemplary circuit diagram of a pixel circuit. FIG. 4 is a timing chart describing a method of driving the pixel circuit.

An organic EL display device 10 can include a signal generating circuit 11, an active matrix part 12, a scanning line driving circuit 13, a data line driving circuit 14, and a power source line control circuit 15. The signal generating circuit 11, the scanning line driving circuit 13, the data line driving circuit 14, and the power source line control circuit 15 may be constructed using an independent electronic component, respectively. For example, the signal generating circuit 11, the scanning line driving circuit 13, the data line driving circuit 14, and the power source line control circuit 15 may be constructed using one chip of a semiconductor integrated circuit device, respectively. In addition, all or a part of the signal generating circuit 11, the scanning line driving circuit 13, the data line driving circuit 14, and the power source line control circuit 15 may be constructed using a programmable IC chip, and the functions thereof may be executed by software programs written in the IC chip.

The signal generating circuit 11 generates scanning control signals and data control signals for displaying images in the active matrix part 12 based on image data from an external device (not shown). Furthermore, the signal generating circuit 11 outputs the scanning control signals to the scanning line driving circuit 13 and outputs the data control signals to the data line driving circuit 14. Moreover, the signal generating circuit 11 outputs timing control signals to the power source line control circuit 15.

The active matrix part 12 has pixel circuits 20 as a plurality of unit circuits, which are arranged at positions corresponding to the intersection portions of M data lines Xm (m=1 to M, where m is a natural number) extending in a row direction and N scanning lines Yn (n=1 to N, where n is a natural number) extending in a column direction, as shown in FIG. 2. Furthermore, a plurality of pixel circuits 20 constitutes one electronic circuit.

That is, the respective pixel circuits 20 are connected to the data lines Xm extending in the column direction thereof and the scanning lines Yn extending in the row direction thereof to form a matrix shape. Furthermore, the respective pixel circuits 20 are connected to first power source lines VL1 extending in parallel to the scanning lines Yn. The respective first power source lines VL1 are connected through driving-voltage supplying transistors Qv to a voltage supply line Lo, which is extended in the column direction of the pixel circuits 20 arranged at the right end side of the active matrix part 12 and supplies a driving voltage Vdd as a driving voltage.

As shown in FIG. 2, each pixel circuit 20 has an organic EL element 21 as an electro-optical element or an electronic element whose light-emitting layer is made of an organic material. Furthermore, by tuning on the driving-voltage supplying transistors Qv, the driving voltage Vdd is supplied to the pixel circuits 20 through the first power source lines VL1. Moreover, transistors (which are described later) arranged in the respective pixel circuits 20 comprise a TFT (Thin Film Transistor), respectively.

The scanning line driving circuit 13 selects one scanning line from the N scanning lines Yn arranged in the active matrix part 12 based on the scanning control signal outputted from the signal generating circuit 11, and then outputs a scanning signal to the selected scanning line.

The data line driving circuit 14 can include a plurality of single line drivers 23 as shown in FIG. 2. Each of the single line drivers 23 can be connected to the corresponding data line Xm arranged in the active matrix part 12. The data line driving circuit 14 generates data currents Idata1, Idata2, . . . , IdataM, respectively, based on the data control signals outputted from the signal generating circuit 11. Then, the data line driving circuit 14 outputs the generated data currents Idata1, Idata2, . . . , IdataM to the respective pixel circuits 20. If the internal conditions of the pixel circuits are established in accordance with the respective data currents Idata1, Idata2, . . . , IdataM, the pixel circuits 20 control the driving currents Ie1 to be supplied to the organic EL elements 21 in accordance with current levels of the data currents Idata1, Idata2, . . . , IdataM.

The power source line control circuit 15 is connected to gates of the driving-voltage supplying transistors Qv through the power source line control lines F. The power source line control circuit 15 generates and supplies power source line control signals SFC to determine ON/OFF states of the driving-voltage supplying transistors Qv based on the timing control signals outputted from the signal generating circuit 11.

In addition, by turning on the driving-voltage supplying transistors Qv, the driving voltage Vdd is supplied to the first power source lines VL1, and the driving voltage Vdd is supplied to the pixel circuits 20 connected to the first power source lines VL1.

Next, the pixel circuits 20 of the organic EL display device 10 will be described.

As shown in FIG. 3, each pixel circuit 20 can include a driving transistor Q1, a transistor Q2, a switching transistor Q3, and a holding capacitor Co.

A conductive type of the driving transistor Q1 is a p type (p channel). In addition, conductive types of the transistor Q2 and the switching transistor Q3 are an n type (n channel), respectively.

A drain of the driving transistor Q1 is connected to an anode (positive electrode) of the organic EL element 21 and a drain of the transistor Q2. A cathode (negative electrode) of the organic EL element 21 is connected to ground. A source of the transistor Q2 is connected to a gate of the driving transistor Q1. A gate of the transistor Q2 is connected to a second secondary scanning line Yn2 together with gates of transistors Q2 of other pixel circuits 20 arranged in the row direction of the active matrix part 12.

A first electrode La of the holding capacitor Co is connected to the gate of the driving transistor Q1, and a second electrode Lb of the holding capacitor Co is connected to the source of the driving transistor Q1.

The source of the driving transistor Q1 is connected to a source of the switching transistor Q3. A drain of the switching transistor Q3 is connected to the data line Xm. A gate of the switching transistor Q3 is connected to a first secondary scanning line Yn1. Furthermore, the first secondary scanning line Yn1 and the second secondary scanning line Yn2 constitute one scanning line Yn.

Furthermore, the source of the driving transistor Q1 is connected to the first power source line VL1 together with the sources of the driving transistors Q1 of other pixel circuits 20. The first power source line VL1 is connected to a drain of the driving-voltage supplying transistor Qv, which is a tenth terminal. A source of the driving-voltage supplying transistor Qv, which is a ninth terminal, is connected to the voltage supply line Lo.

A conductive type of the driving-voltage supplying transistor Qv is a p type (p channel). The driving-voltage supplying transistor Qv is switched to the electrical disconnection state (off state) or the electrical connection state (on state) in accordance with the power source line control signal SFC to be supplied from the power source line control circuit 15 through the power source line control line F. When the driving-voltage supplying transistor Qv is switched into an on state, the driving voltage Vdd is supplied to the driving transistor Q1 of each pixel circuit 20 connected to the first power source line VL1 to which the driving-voltage supplying transistor Qv is connected.

Next, a method of driving the pixel circuits 20 constructed as described above will be described with reference to FIG. 4. In FIG. 4, a driving cycle Tc means a cycle in which the brightness of the organic EL elements 21 is updated once, and normally corresponds to a frame period of time.

First, as shown in FIG. 4, a data current Idata is supplied from the data line driving circuit 14. In this state, a first scanning signal SC1 for switching the switching transistor Q3 to on state is supplied from the scanning line driving circuit 13 to the gate of the switching transistor Q3 through the first secondary scanning line Yn1. Furthermore, at that time, a second scanning signal SC2 for switching the transistor Q2 to on state is supplied from the scanning line driving circuit 13 to the gate of the transistor Q2 through the second secondary scanning line Yn2.

Accordingly, the switching transistor Q3 and the transistor Q2 become on state, respectively. Then, the data current Idata flows through the driving transistor Q1. In this way, the quantity of charge corresponding to the data current Idata is held in the holding capacitor Co, and the electrical connection state between the source and the drain of the driving transistor Q1 is determined depending upon a gate voltage Vo corresponding to the quantity of charge.

Thereafter, the first scanning signal SC1 for switching the switching transistor Q3 to off state is supplied from the scanning line driving circuit 13 to the gate of the switching transistor Q3 through the first secondary scanning line Yn1. Furthermore, at that time, the second scanning signal SC2 for switching the transistor Q2 to off state is supplied from the scanning line driving circuit 13 to the gate of the transistor Q2 through the second secondary scanning line Yn2. By doing so, the switching transistor Q3 and the transistor Q2 become off state, respectively, and the data line Xm is electrically disconnected from the driving transistor Q1.

Furthermore, for the time period in which the data current Idata is supplied to the driving transistor Q1, the driving-voltage supplying transistor Qv is in an off state by the power source line control signal SFC, which is supplied from the power source line control circuit 15 to switch the driving-voltage supplying transistor Qv to off state.

Subsequently, the power source line control signal SFC for switching the driving-voltage supplying transistor Qv to on state is supplied from the power source line control circuit 15 to the gate of the driving-voltage supplying transistor Qv through the power source line control line F. Thus, the driving-voltage supplying transistor Qv becomes on state, and then the driving voltage Vdd is supplied to the source of the driving transistor Q1.

By doing so, the driving current Ie1 according to the electrical connection state set by the data current is supplied to the organic EL element 21, and thus the organic EL element 21 emits light. At that time, in order to make the driving current Ie1 be substantially equal to the data current Idata, it is preferable that the driving transistor Q1 be set to be driven in a saturated area.

As described above, by using the data current Idata as a data signal, the deviations of various electrical characteristic parameters of each of the driving transistors Q1, such as threshold voltage and gain coefficient, can be compensated.

Until the driving-voltage supplying transistor Qv is switched into off state, the organic EL element 21 continuously emits light with the brightness corresponding to the data current Idata.

As described above, the number of transistors used in the pixel circuit 20 can be reduced by one as compared with the conventional pixel circuit requiring four transistors. Therefore, it is possible to enhance the yield or the aperture ratio in manufacturing transistors of the pixel circuit 20.

According to the electronic circuit or the electro-optical device of the aforementioned embodiment, the following features can be obtained.

In this embodiment, each of the pixel circuits 20 can include the driving transistor Q1, the transistor Q2, the switching transistor Q3, and the holding capacitor Co. In addition, the driving-voltage supplying transistors Qv are connected between the first power source lines VL1, which supply the driving voltage Vdd for driving the driving transistors Q1, and the voltage supply line Lo extending in the column direction of the pixel circuits 20 provided at the right end side of the active matrix part 12.

By such constitution, the number of transistors used in the pixel circuit 20 can be reduced as compared with a conventional pixel circuit. Therefore, it is possible to provide the organic EL display device 10 having pixel circuits suitable for enhancing the yield or the aperture ratio in manufacturing the transistors.

Next, a second embodiment according to the present invention will be described with reference to FIG. 5. In this embodiment, like reference numerals are attached to constructional members similar to those of the first embodiment, and a detailed description thereof will thus be omitted.

Figure 5:
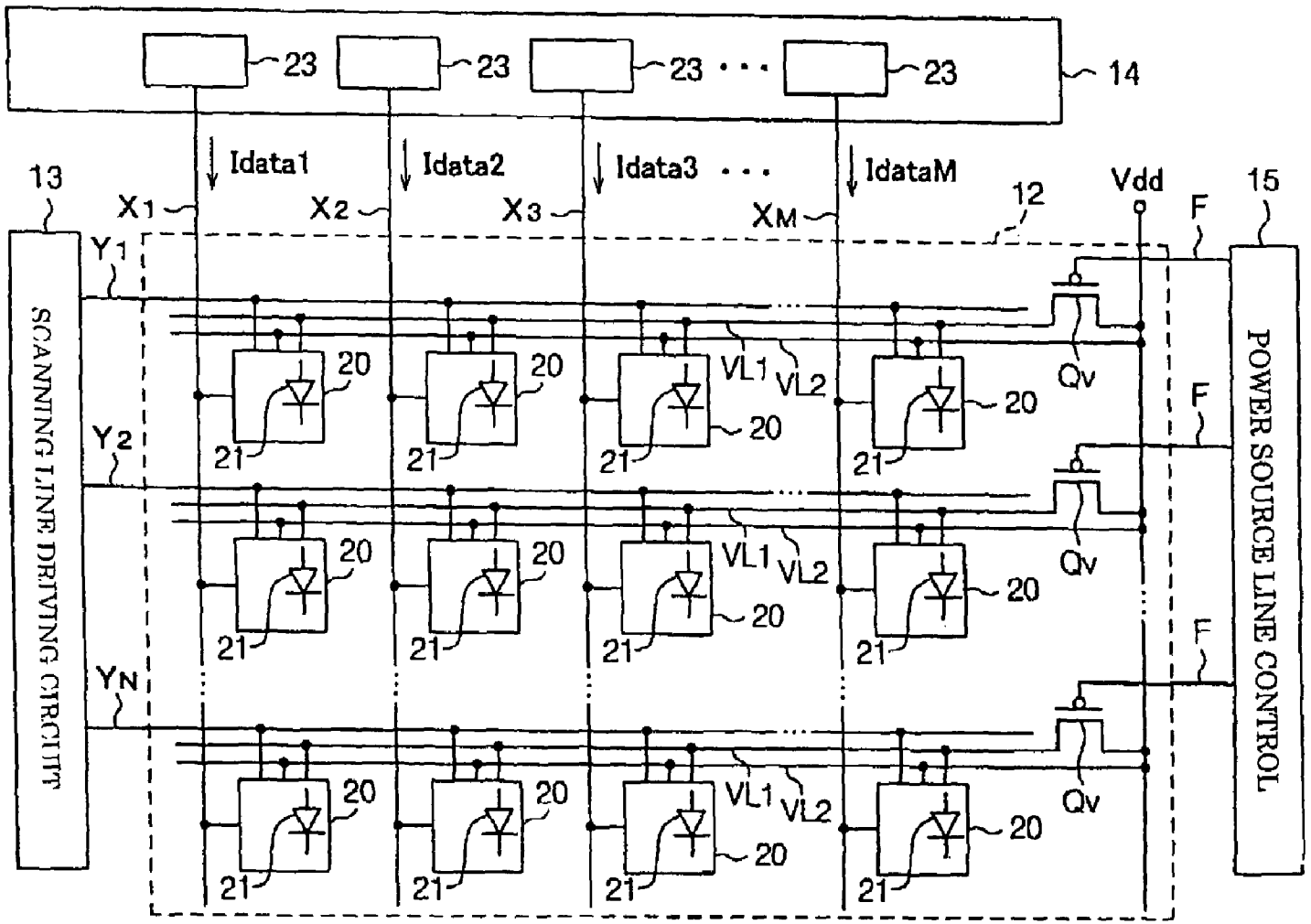
FIG. 5 is an exemplary circuitry block diagram illustrating a circuit configuration of a display panel part and a data line driving circuit according to the second embodiment.
Figure 6:
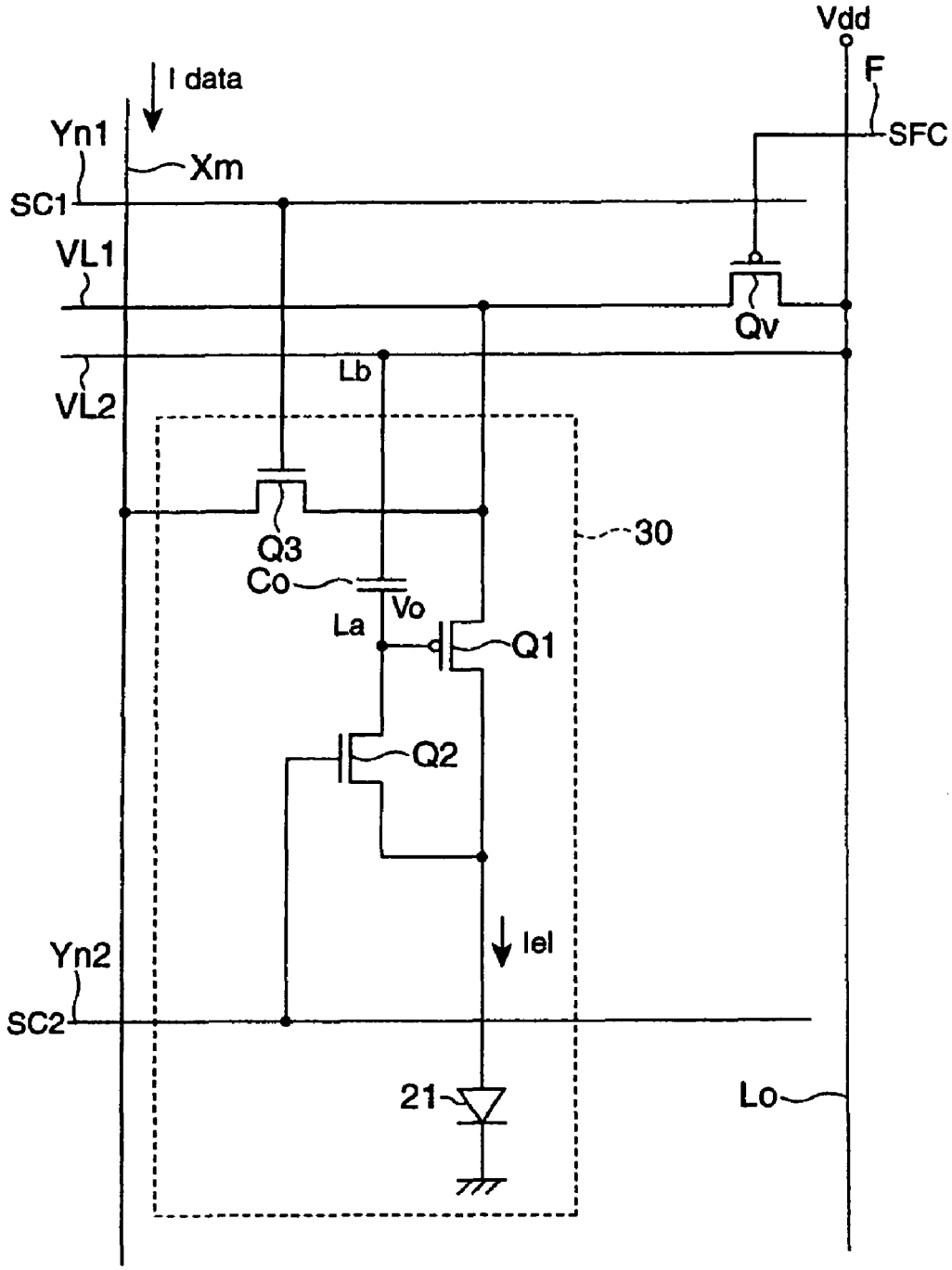
FIG. 6 is an exemplary circuit diagram of a pixel circuit according to the second embodiment.

FIG. 5 is an exemplary circuitry block diagram illustrating a circuit configuration of the active matrix part 12*a* and the data line driving circuit 14 of the organic EL display device 10 according to the second embodiment. FIG. 6 is an exemplary circuit diagram of pixel circuits 30 arranged in the active matrix part 12*a*.

The active matrix part 12 is provided with second power source lines VL2 in parallel to the first power source lines VL1. As shown in FIG. 6, each of the plurality of second power source lines VL2 is connected to the holding capacitor Co of each pixel circuit 30 and connected to the voltage supply line Lo.

As shown in FIG. 6, each pixel circuit 30 can include the driving transistor Q1, the transistor Q2, the switching transistor Q3, and the holding transistor Co.

The drain of the driving transistor Q1 is connected to an anode of an organic EL element 21 and the drain of the transistor Q2. A cathode of the organic EL element 21 is connected to ground. The source of the transistor Q2 is connected to the gate of the driving transistor Q1 and the first electrode of the holding capacitor Co. The gate of the transistor Q2 is connected to the second secondary scanning line Yn2.

The second electrode Lb of the holding capacitor Co is connected to the second power source line VL2. For this reason, a constant driving voltage is always supplied to the holding capacitor Co independently, regardless of on/off states of the driving-voltage supplying transistor Qv.

As described above, since the second electrode Lb of the holding capacitor is connected to the second power source line VL2, the variation in voltage of the holding capacitor can be prevented when the data current Idata is supplied to the driving transistor Q1 and when the driving voltage is applied to the source of the driving transistor Q1.

As a result, according to these pixel circuits 30, it is possible to control the gray scale in brightness of the organic EL element 21 with a higher accuracy compared with the aforementioned first embodiment, as well as to obtain advantages similar to the aforementioned first embodiment.

The source of the driving transistor Q1 is connected to the first power source lines VL1 and is also connected to the source of the switching transistor Q3. The drain of the switching transistor Q3 is connected to the data line Xm. The gate of the switching transistor Q3 is connected to the first secondary scanning line Yn1.

Next, a method of driving the pixel circuits 30 constructed as described above will be described.

First, the data current Idata is supplied from the data line driving circuit 14. In this state, the first scanning signal SC1 for switching the switching transistor Q3 to on state is supplied from the scanning line driving circuit 13 to the gate of the switching transistor Q3 through the first secondary scanning line Yn1. Furthermore, at that time, the second scanning signal SC2 for switching the transistor Q2 to on state is supplied from the scanning line driving circuit 13 to the gate of the transistor Q2 through the second secondary scanning line Yn2.

By doing so, the switching transistor Q3 and the transistor Q2 become on state, respectively. Then, the data current Idata flows through the driving transistor Q1 and the transistor Q2, and the quantity of charge corresponding to the data current Idata is held in the holding capacitor Co.

Thus, the electrical connection state between the source and the drain of the driving transistor Q1 is established.

Thereafter, the first scanning signal SC1 for switching the switching transistor Q3 to off state is supplied from the scanning line driving circuit 13 to the gate of the switching transistor Q3 through the first secondary scanning line Yn1. Furthermore, at that time, the second scanning signal SC2 for switching the transistor Q2 to off state is supplied from the scanning line driving circuit 13 to the gate of the transistor Q2 through the second secondary scanning line Yn2. As a result, the switching transistor Q3 and the transistor Q2 become off state, respectively, and the driving transistor Q1 is electrically disconnected from the data line Xm.

Furthermore, at least for part of the time period in which the data current Idata is supplied to the driving transistor Q1, the driving-voltage supplying transistor Qv is in an off state by the power source line control signal SFC, which is supplied from the power source line control circuit 15 to switch the driving-voltage supplying transistor Qv to off state.

Subsequently, the power source line control signal SFC for switching the driving-voltage supplying transistor Qv to on state is supplied from the power source line control circuit 15 to the gate of the driving-voltage supplying transistor Qv through the power source line control line F. By doing so, the driving-voltage supplying transistor Qv is switched to on state, and then the driving voltage Vdd is supplied to the source of the driving transistor Q1. At that time, since the driving voltage Vdd is always to the second electrode Lb of the holding capacitor Co independently, regardless of on/off states of the driving-voltage supplying transistor Qv, the variation in voltage of the holding capacitor can be prevented when the quantity of charge corresponding to the data current Idata is held in the holding capacitor Co and when the driving current Iel is supplied from the driving transistor Q1 to the organic EL element 21 by switching the driving-voltage supplying transistor Qv to on state. Therefore, the driving current Iel corresponding to the voltage Vo held in the holding capacitor Co is supplied to the organic EL element.

Next, applications of the organic EL display device 10 as the electro-optical device described in the first or second embodiment to electronic apparatuses will be described with reference to FIGS. 7 and 8. The organic EL display device 10 can apply to a variety of electronic apparatuses, such as a portable personal computer, a mobile telephone, a digital camera and the like.

Figure 7:
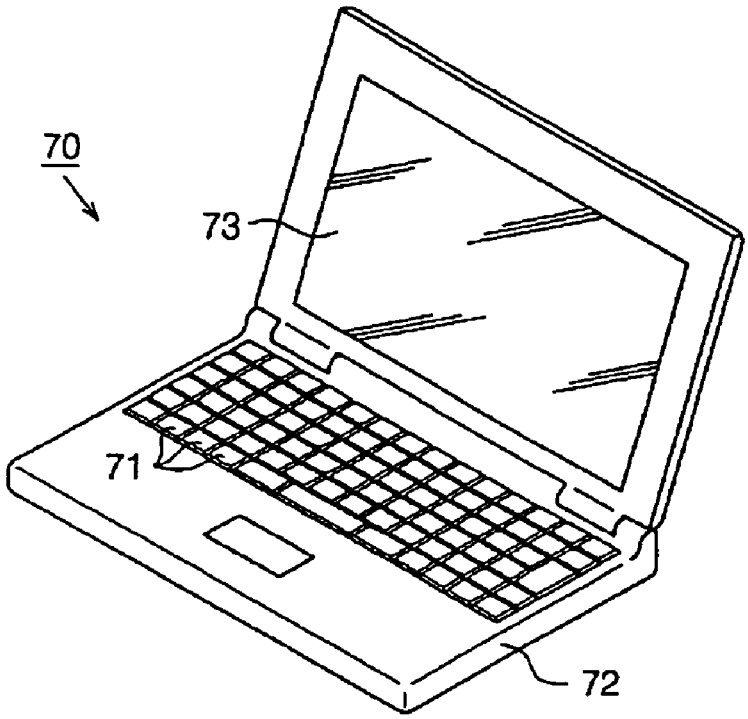
FIG. 7 is an exemplary perspective view illustrating a construction of a portable personal computer for explaining the third embodiment.

FIG. 7 is a perspective view illustrating a construction of a portable personal computer. In FIG. 7, the personal computer 70 can include a main body part 72 having a keyboard 71, and a display unit 73 using the organic EL display device 10.

In this case again, the display unit 73 using the organic EL display device 10 has advantages similar to those of the aforementioned embodiments. As a result, it is possible to provide the mobile type personal computer 70 having the organic EL display device 10 capable of accurately controlling a gray scale in brightness of the organic EL elements 21 and improving a yield or aperture ratio.

Figure 8:
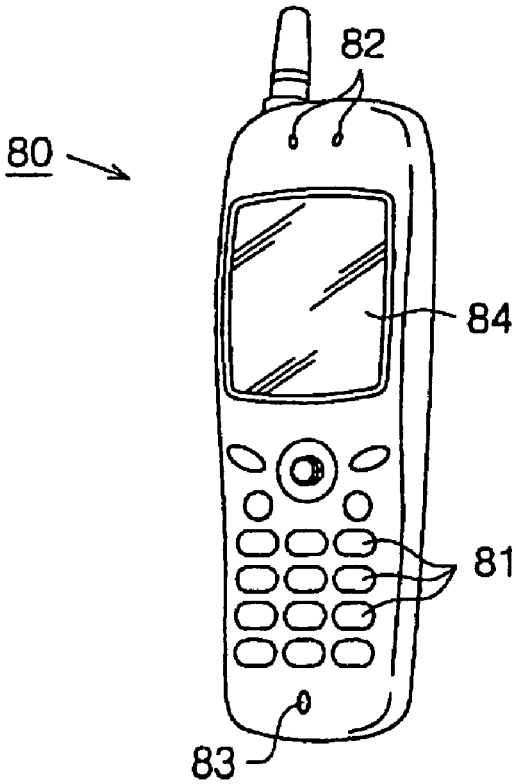
FIG. 8 is an exemplary perspective view illustrating a construction of a mobile telephone for explaining the third embodiment.

FIG. 8 is a perspective view illustrating a construction of a mobile telephone. In FIG. 8, the mobile telephone 80 can include a plurality of manipulation buttons 81, a receiver 82, a transmitter 83, and a display unit 84 using the organic EL display device 10. In this case again, the display unit 84 using the organic EL display device 10 has advantages similar to those of the aforementioned embodiments. As a result, it is possible to provide the mobile telephone 80 having the organic EL display device 10 capable of accurately controlling a gray scale in brightness of the organic EL elements 21 and improving a yield or aperture ratio.

It should be noted that embodiments of the present invention are not limited to the embodiments described above, but may be implemented as follows.

In the aforementioned embodiments, the conductive types of the driving transistors Q1 of the pixel circuits 20, 30 are set to be a p type (p channel), and the respective conductive types of the transistors Q2 and the switching transistors Q3 are set to be an n type (n channel). In addition, the drains of the driving transistors Q1 are connected to the anodes of the organic EL elements 21. Furthermore, the cathodes of the organic EL elements 21 are connected to ground.

On the contrary, the conductive types of the driving transistors Q1 may be set to be an n type (n channel), and the respective conductive types of the switching transistors Q3 and the transistors Q2 may be set to be a p type (p channel).

In the above embodiments, although the pixel electrodes are used as the anode and a common electrode common to a plurality of pixel is used as the cathode, the pixel electrodes may be used as the cathode, and the common electrodes may be established as the anode.

In the first embodiment and the second embodiment as described above, the gates of the switching transistors Q3 included in the pixel circuits are connected to the first secondary scanning line Yn1. In addition, the gates of the transistors Q2 are connected to the second secondary scanning line Yn2. Furthermore, the first secondary scanning line Yn1 and the second secondary scanning line Yn2 constituted the scanning lines Yn.

Figure 9:
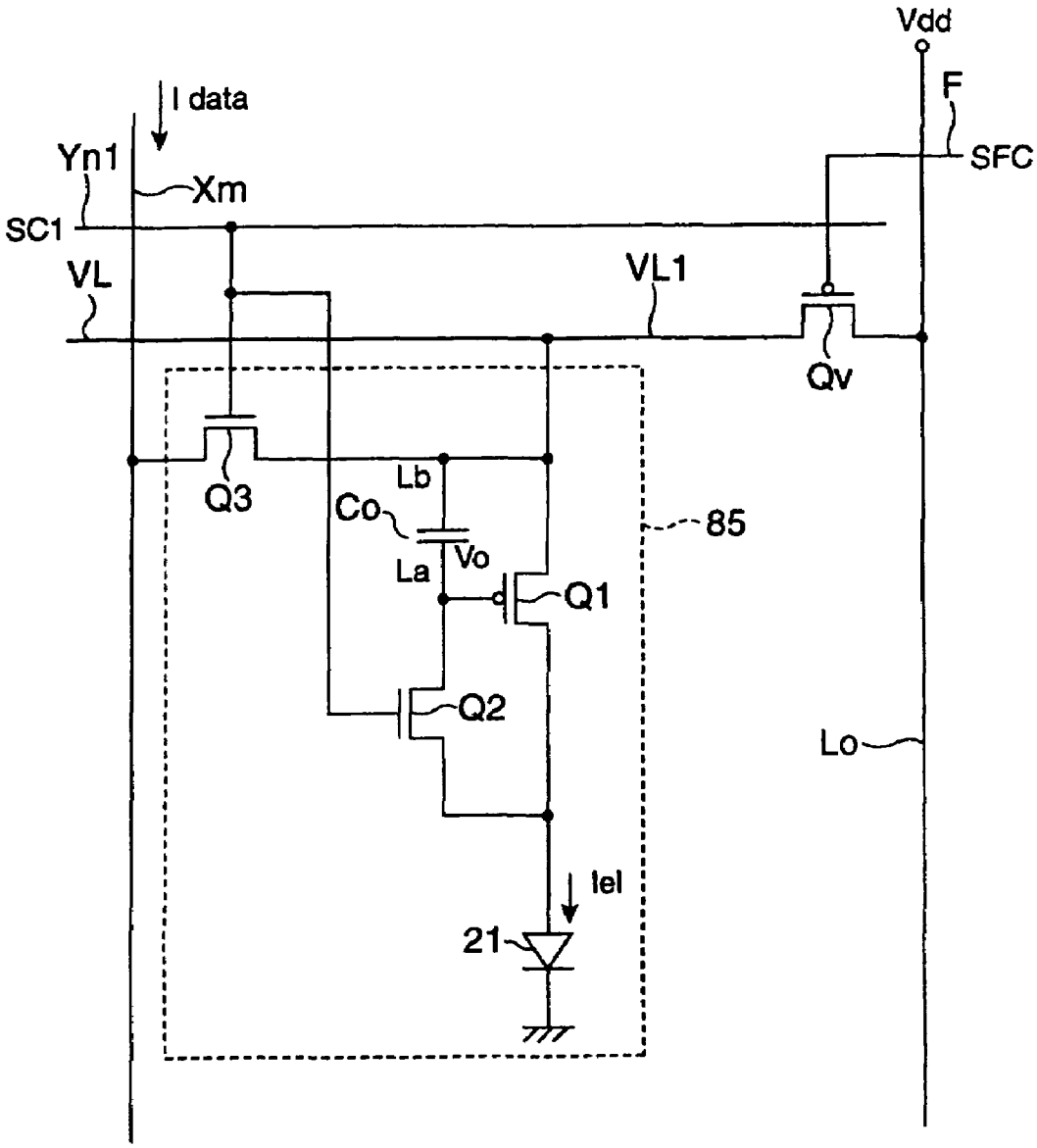
FIG. 9 is an exemplary circuit diagram illustrating a pixel circuit according to another modification.
Figure 10:
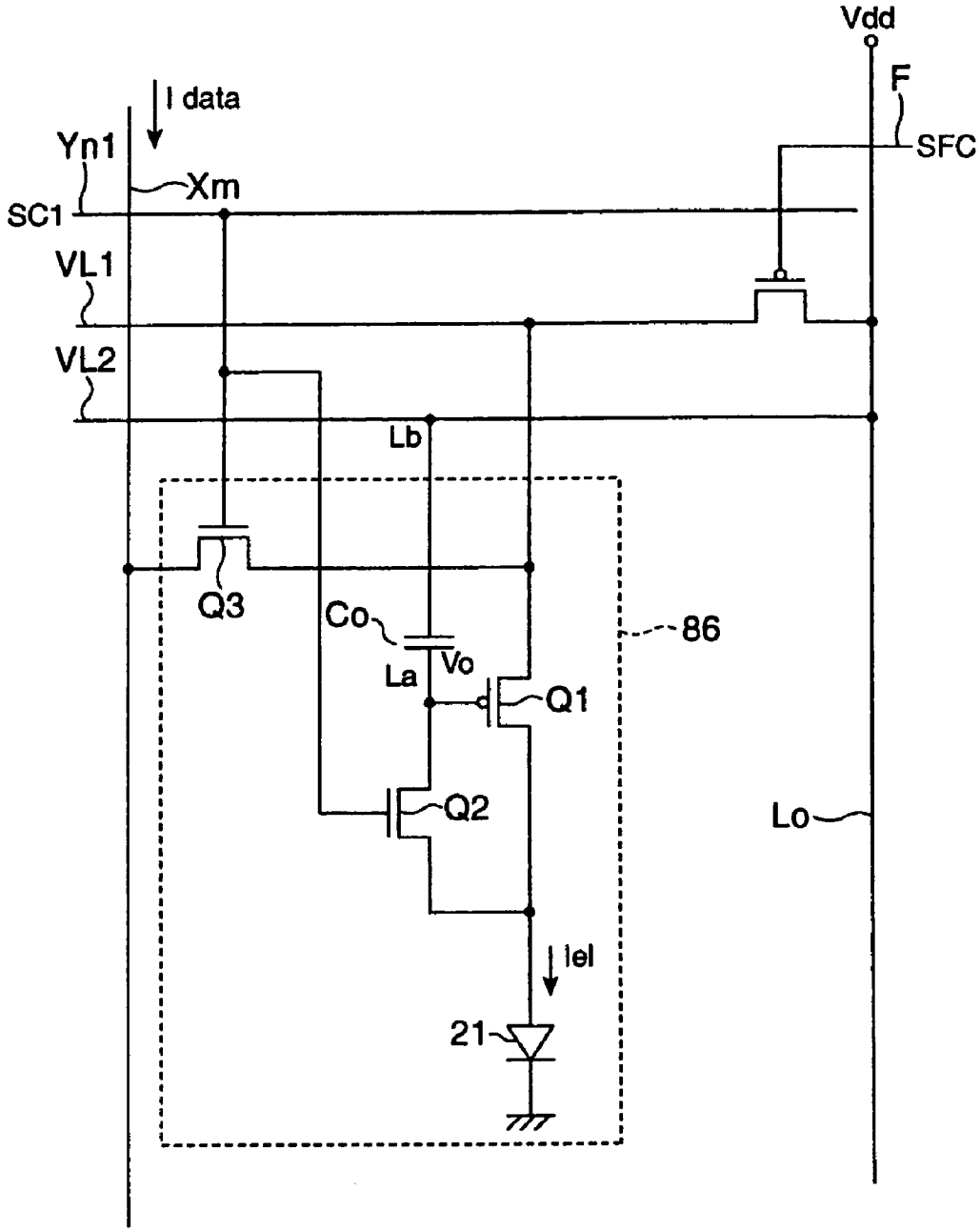
FIG. 10 is an exemplary circuit diagram illustrating a pixel circuit according to still another modification.

On the contrary, as shown in FIG. 9 or 10, the transistors Q2 and the switching transistors Q3 may be controlled by the common scanning signal SC1. Thus, one scanning line is provided in one pixel circuit, and thus the number of wires for every pixel circuit can be reduced, so that it is possible to improve the aperture ratio.

In the aforementioned embodiments, the driving-voltage supplying transistors Qv are used as a control circuit for controlling the supply of the driving voltage Vdd to the pixel circuits. On the contrary, instead of the driving-voltage supplying transistors Qv, switches capable of switching between low potential and high potential may be provided. Furthermore, a buffer circuit or a voltage follower circuit, including a source follower circuit, may be used as the control circuit in order to improve the driving ability thereof. By such constitution, it is possible to rapidly supply the driving voltage Vdd to the pixel circuits.

Although the voltage supply line Lo is provided at the right end side of the active matrix part 12 in the aforementioned embodiments, the voltage supply line Lo is not necessarily provided at that position but may be provided, for example, at the left end side of the active matrix part 12.

The voltage supply line Lo may be provided at the same end side of the active matrix part 12 as the scanning line driving circuit 13.

The power source line control circuit 15 may be provided at the same end side of the active matrix part 12 as the scanning line driving circuit 13.

Although it is described in the aforementioned embodiments that the present invention applies to the organic EL elements, it should be understood that the present invention may also be applied to unit circuits for driving a variety of electro-optical elements, such as LEDs, FEDs, liquid crystal elements, inorganic EL elements, electrophoresis elements, and electron emitting elements, in addition to the organic EL elements. Furthermore, the present invention may be applied to storage devices, such as RAM (specifically, MRAM) and the like.

What is claimed is:

1. A method of driving an electronic circuit that has a plurality of first power source lines, a plurality of second power source lines and a plurality of unit circuits each of which includes:

a first transistor that has a first terminal, a second terminal, and a first control terminal, the first terminal being coupled to one first power source line of the plurality of first power source lines;

a second transistor that has a third terminal and a fourth terminal, the third terminal being coupled to the first control terminal, the fourth terminal being coupled to the second terminal;

a third transistor that has a fifth terminal and a sixth terminal, the fifth terminal being coupled to the first terminal; and a capacitive element that has a seventh terminal and an eighth terminal, the seventh terminal being coupled to the first control terminal and the third terminal and the eighth terminal being coupled to one second power source line of the plurality of second power source lines, the method comprising:

supplying an electric charge to the capacitive element, a quantity of the electric charge corresponding to a data current flowing through the third transistor, and supplying a driving current to an electronic element, the driving current flowing between the one first power source line and the electronic element through the first transistor, and the driving current having a level corresponding to the quantity of the electric charge, the one first power source line being electrically disconnected from a driving voltage during at least a part of a first period in which the supplying of the electric charge to the capacitive element is performed, the driving voltage being applied to the first terminal of the first transistor through the one first power source line during at least a part of a second period in which the supplying of the driving current to the electronic element is performed, and the one second power source line being held at a predetermined voltage during the first period and the second period.

2. A method of driving an electronic circuit that has a plurality of unit circuits and a plurality of first power source lines each of which includes:

a first transistor that has a first terminal, a second terminal, and a first control terminal, the first terminal being coupled to one first power source line of the plurality of first power source lines;

a second transistor that has a third terminal and a fourth terminal, the third terminal being coupled to the first control terminal, and the fourth terminal being coupled to the second terminal;

a third transistor that has a fifth terminal and a sixth terminal, the fifth terminal being coupled to the first terminal; and a capacitive element that has a seventh terminal and an eighth terminal, the seventh terminal being coupled to the first control terminal and the third terminal, the method comprising:

supplying an electric charge to the capacitive element, a quantity of the electric charge corresponding to a data signal supplied through the third transistor, and supplying a driving current to an electronic element, the driving current flowing between the one first power source line and the electronic element through the first transistor, and the driving current having a level corresponding to the quantity of the electric charge, the one first power source line being electrically disconnected from a driving voltage during at least a part of a first period in which the supplying of the electric charge to the capacitive element is performed, and the driving voltage being applied to the first terminal of the first transistor through the one first power source line during at least a part of a second period in which the supplying of the driving current to the electronic element is performed.

3. A method of driving an electronic circuit that has a plurality of first power source lines and a plurality of unit circuits each of which includes:

a first transistor that is coupled to one first power source line of the plurality of first power source lines;

a second transistor that controls an electrical connection between a drain of the first transistor and a gate of the first transistor; and a third transistor that controls an electrical connection between the first transistor and a current source that outputs a data current that sets a conduction state of the first transistor, the method comprising:

supplying the data current to the first transistor through the third transistor, and supplying a driving current whose level corresponds to the conduction state of the first transistor to an electronic element, the driving current flowing through the first transistor, the one first power source line being electrically disconnected from a driving voltage during at least a part of a first period in which the supplying of the data current to the first transistor is performed, and the driving voltage being applied to a drain of the first transistor or a source of the first transistor through the first power source line during at least a part of a second period in which the supplying of the driving current to the electronic element is performed.

4. A method of driving an electronic circuit that has a plurality of first power source lines and a plurality of unit circuits, each of which includes:

a first transistor that has a first terminal, a second terminal, and a first control terminal, the first terminal being coupled to one first power source line of the plurality of the first power source lines;

a second transistor that has a third terminal and a fourth terminal, the third terminal being coupled to the first control terminal, and the fourth terminal being coupled to the second terminal;

a third transistor that has a fifth terminal and a sixth terminal, the fifth terminal being coupled to the first terminal; and a capacitive element that has a seventh terminal and an eighth terminal, the seventh terminal being coupled to the first control terminal and the third terminal, the method comprising:

supplying an electric charge to the capacitive element, a quantity of the electric charge corresponding to a data current flowing through the third transistor; and supplying a driving current to an electronic element, the driving current flowing between the one first power source line and the electronic element through the first transistor, and the driving current having a level corresponding to the quantity of the electric charge, the one first power source line being electrically disconnected from a driving voltage during at least a part of a first period in which the supplying of the electric charge to the capacitive element is performed, and the driving voltage being applied to the first terminal of the first transistor through the one first power source line during at least a part of a second period in which the supplying of the driving current to the electronic element is performed.

5. The method according to claim 4, the data current flowing through the first transistor.

6. An electronic circuit comprising:

a first power source line; and a plurality of unit circuits, each of the plurality of unit circuits including:

a first transistor that is coupled to an electronic element and that is coupled to the first power source line;

a second transistor that controls an electrical connection between a drain of the first transistor and a gate of the first transistor; and a third transistor that controls an electrical connection between the first transistor and a current source that outputs a data current that sets a conduction state of the first transistor, the first power source line being electrically disconnected from a driving potential during at least a part of a first period in which the third transistor is in an on-state, a driving current flowing through the electronic element during at least a part of a second period in which the third transistor is in an off-state, a source or a drain of the first transistor being electrically connected to the driving potential during at least a part of the second period, and the driving current having a level corresponding to the conduction state of the first transistor set by the data current.

7. An electronic circuit comprising:

a first power source line; and a plurality of unit circuits, each of the plurality of unit circuits including:

a first transistor that is coupled to an electronic element and that is coupled to the first power source line;

a second transistor that controls an electrical connection between a drain of the first transistor and a gate of the first transistor; and a third transistor that controls an electrical connection between the first transistor and a current source that outputs a data current that sets a conduction state of the first transistor, the data current flowing through the first transistor during at least a part of a first period in which the third transistor is in an on-state, a potential of the first power source line being set to a first voltage during at least a part of the first period, a driving current flowing through the first transistor during at least a part of a second period in which the third transistor is in an off-state, the driving current having a level corresponding to the conduction state of the first transistor set by the data current, the potential of the first power source line being set to a second voltage that is different from the first voltage during at least a part of the second period, and a source or a drain of the first transistor being electrically connected to the first power source line during at least a tart of the second period.

8. An electronic circuit comprising:

a plurality of unit circuits; and a first power source line, each of the plurality of unit circuits including:

a first transistor having a first terminal, a second terminal, and a first control terminal;

a second transistor having a third terminal and a fourth terminal; and a third transistor having a fifth terminal and a sixth terminal, the fifth terminal being coupled to the first terminal, a conduction state between the first terminal and the second terminal being set according to a voltage of the first control terminal, the first terminal being coupled to the first power source line, and a potential of the first power source line being set to a plurality of potential levels or an electrical connection between the first power source line and a driving voltage being controlled.

9. An electronic circuit comprising:

a first power source line;

a control circuit that sets the potential of the first power source line to a plurality of potential levels or controls an electrical connection between a driving voltage and the first power source line; and a plurality of unit circuits, each of the plurality of unit circuits including:

a first transistor having a first terminal, a second terminal, and a first control terminal;

a second transistor having a third terminal and a fourth terminal, the third terminal being coupled to the first control terminal, the second transistor controlling an electrical connection between the second terminal and the first control terminal;

a third transistor having a fifth terminal and a sixth terminal, the fifth terminal being coupled to the first terminal; and a capacitive element having a seventh terminal and an eighth terminal, the seventh terminal being coupled to the first control terminal and the third terminal, a conduction state between the first terminal and the second terminal being set according to a voltage of the first control terminal, and the first terminal being connected to the first power source line.

10. An electronic circuit comprising:

a first power source line;

a second power source line that is held at a predetermined potential;

a control circuit that sets the potential of the first power source line to a plurality of potential levels or controls an electrical connection between a driving voltage and the first power source line; and a plurality of unit circuits, each of the plurality of unit circuits including:

a first transistor having a first terminal, a second terminal, and a first control terminal;

a second transistor having a third terminal and a fourth terminal, the third terminal being coupled to the first control terminal, the second transistor controlling an electrical connection between the second terminal and the first control terminal;

a third transistor having a fifth terminal and a sixth terminal, the fifth terminal being coupled to the first terminal; and a capacitive element having a seventh terminal and an eighth terminal, the seventh terminal being coupled to the first control terminal and the third terminal, a conduction state between the first terminal and the second terminal being set according to a voltage of the first control terminal, the first terminal being coupled to the first power source line together with the first terminals of other unit circuits of the plurality of unit circuits, and the eighth terminal being coupled to the second power source line.

11. The electronic circuit according to claim 1, transistors included in each of the unit circuits including only the first transistor, the second transistor, and the third transistor.

12. The electronic circuit according to claim 1, the electronic element being a current-driven element.

13. An electronic apparatus equipped with the electronic circuit according to claim 1.

14. The electronic circuit according to claim 8, an electronic element being coupled to the second terminal.

15. The electronic circuit according to claim 9, each of the control circuits being a fourth transistor having a ninth terminal and a tenth terminal, the ninth terminal being coupled to the driving voltage, and the tenth terminal being coupled to the first power source line.

* * * * *